US010060302B2

(12) United States Patent
Weng et al.

(10) Patent No.: US 10,060,302 B2
(45) Date of Patent: Aug. 28, 2018

(54) PASSIVE LOW TEMPERATURE HEAT SOURCES ORGANIC WORKING FLUID POWER GENERATION METHOD

(71) Applicant: SHANGHAI JIAOTONG UNIVERSITY, Shanghai (CN)

(72) Inventors: Yiwu Weng, Shanghai (CN); Xiaojing Lv, Shanghai (CN); Yuping Wang, Shanghai (CN); Zemin Bo, Shanghai (CN); Zhenkun Sang, Shanghai (CN); Xiaoru Geng, Shanghai (CN); Chaohao Lu, Shanghai (CN)

( * ) Notice: Subject to any disclaimer, the term of this patent is extended or adjusted under 35 U.S.C. 154(b) by 0 days.

(21) Appl. No.: 15/361,387

(22) Filed: Nov. 26, 2016

(65) Prior Publication Data

US 2017/0074124 A1 Mar. 16, 2017

Related U.S. Application Data

(63) Continuation-in-part of application No. 14/875,693, filed on Oct. 6, 2015, which is a continuation-in-part (Continued)

(30) Foreign Application Priority Data

Oct. 21, 2013 (CN) ..... 2013 1 0496376

(51) Int. Cl.
*F01K 25/10* (2006.01)
*F01K 7/16* (2006.01)

(Continued)

(52) U.S. Cl.
CPC ..... *F01K 25/10* (2013.01); *F01K 7/16* (2013.01); *F01K 11/02* (2013.01); *F01K 13/006* (2013.01);

(Continued)

(58) Field of Classification Search
CPC ..... F01K 13/006; F01K 7/16; F01K 11/02; F01K 13/02; F01K 25/00
See application file for complete search history.

(56) References Cited

U.S. PATENT DOCUMENTS 3,237,403 A * 3/1966 Feher ..... F01K 7/32 60/647
3,878,683 A * 4/1975 Imai ..... F01K 25/10 60/647

(Continued)

FOREIGN PATENT DOCUMENTS

CN 101196354 A 6/2008
CN 101614139 A 12/2009

(Continued)

*Primary Examiner* — Mark Laurenzi
*Assistant Examiner* — Shafiq Mian
(74) *Attorney, Agent, or Firm* — Wayne & Ken, LLC; Tony Hom

(57) ABSTRACT

The present invention relates to a passive low temperature heat energy organic working fluid power generation method and system, Comprising: organic working fluid in a first evaporator and a second evaporator are heated to evaporate; when a pressure of the organic working fluid reaches a setting pressure, a self-operating pressure control valve at an outlet of the evaporator is triggered opening by a working pressure, and steam of the organic working fluid flows into a turbine, pushes the turbine to work, and drives a generator to output electric energy; after work is completed, the steam flows into a condenser to be condensed, and working steam is output in turn through the first evaporator and the second evaporator, and thus the turbine is driven continuously to work and output electric energy. Compared with the prior technology, the present invention has reliable performance, and is operated by heating and evaporating of the working fluid in a closed space to achieve increased pressure.

10 Claims, 2 Drawing Sheets

Related U.S. Application Data of application No. PCT/CN2013/085944, filed on Oct. 25, 2013.

(51) Int. Cl.

| | |
|---|---|
| ***F01K 11/02*** | (2006.01) |
| ***F01K 13/00*** | (2006.01) |
| ***F01K 13/02*** | (2006.01) |
| ***F01K 25/08*** | (2006.01) |

(52) U.S. Cl.

CPC ..... *F01K 13/02* (2013.01); *F01K 25/08* (2013.01); *F05D 2220/40* (2013.01)

(56) References Cited

U.S. PATENT DOCUMENTS 4,231,226 A * 11/1980 Griepentrog ..... F17C 9/02 60/648
4,738,111 A * 4/1988 Edwards ..... F01K 25/08 290/1 A
4,995,234 A * 2/1991 Kooy ..... F01K 25/10 60/648
6,691,514 B2 * 2/2004 Bushey ..... F01K 25/10 60/651
6,968,705 B2 * 11/2005 Frati ..... F25D 3/10 62/121
9,222,372 B2 * 12/2015 Benson ..... F01K 25/10
2007/0199323 A1 * 8/2007 Yamaguchi ..... F01K 7/16 60/670
2009/0277198 A1 * 11/2009 Yamaguchi ..... F01K 7/16 62/118
2012/0312021 A1 * 12/2012 Tsuboi ..... F01K 13/02 60/667
2014/0060049 A1 * 3/2014 Conry ..... F01K 11/02 60/650
2014/0245737 A1 * 9/2014 Ikegami ..... F01K 23/02 60/670
2014/0373545 A1 * 12/2014 Mohan ..... F01K 7/165 60/670
2015/0013338 A1 * 1/2015 Smague ..... F01K 13/02 60/645
2015/0113986 A1 * 4/2015 Burkhart ..... F03G 7/04 60/641.2
2015/0167648 A1 * 6/2015 Bergan ..... F03G 6/06 60/641.15
2015/0337690 A1 * 11/2015 Adachi ..... F01K 13/02 60/660

FOREIGN PATENT DOCUMENTS

| | | | |
|---|---|---|---|
| CN | 101922990 | A | 12/2010 |
| CN | 202645658 | U | 1/2013 |
| CN | 202718721 | U | 2/2013 |
| CN | 103147945 | A | 6/2013 |
| EP | 0523467 | A1 | 1/1993 |
| JP | 2011220189 | A | 11/2011 |
| JP | 20130011272 | A | 8/2014 |
| KR | 20120045468 | A | 5/2012 |

* cited by examiner

PASSIVE LOW TEMPERATURE HEAT SOURCES ORGANIC WORKING FLUID POWER GENERATION METHOD

CROSS-REFERENCE TO RELATED APPLICATIONS

This application is a continuation in part of application Ser. No. 14/875,693, filed Oct. 6, 2015, now pending, which is a continuation in part of International Application No. PCT/CN2013/085944, filed Oct. 25, 2013, and further claims priority benefit to Chinese Patent Application No. 201310496376.1 filed Oct. 21, 2013. The content of the aforementioned applications, including any intervening amendments thereto, is incorporated herein by reference.

TECHNICAL FIELD

The present invention relates to a power generation method and system, and more specifically, to a passive low temperature heat energy organic working fluid power generation method and system.

BACKGROUND OF THE INVENTION

Low temperature heat source usually refers to heat sources below 200.degree. C. There are a variety and a huge amount of low temperature heat sources, mainly including solar energy, geothermal energy and industrial waste heat etc. According to statistics, the solar radiation of two-thirds of the whole land area in China is greater than 5000 MJ per square meter, the amount of recoverable geothermal resources in the country is about 3.3 billion tons of standard coal, and the industrial energy consumption accounts for 70 percentage of the total energy consumption, while the industrial waste heat consumption accounts for 15 percent of the total energy consumption. Since the low temperature heat sources are difficult to be utilized by conventional energy conversion devices, most of these energies are discharged into the environment, causing great waste and environmental pollution. Therefore, how to recycle this part of huge amount of energy efficiently becomes a hot topic in the field of energy technology. The organic Rankine cycle power generation system uses low-boiling working fluid, the working fluid steam can flow into the turbine for expansion with a higher pressure, the device has simple structure, feasible technology and high energy efficiency, compared with the traditional steam Rankine cycle power generation system, the organic Rankine cycle power generation system is more suitable to use these low temperature heat sources.

As early as 1924, the scientists began to study the organic Rankine cycle using the low-boiling organic working fluid such as ether. With awareness of worldwide energy crisis increasing, governments and energy scientists focus on organic Rankine cycle technology. The United States, Japan, Israel, Italy, Germany, France and other countries have been devoted a lot of manpower and resources to competing on research and development of organic Rankine cycle power generation technology. At present, the organic working fluid of the Rankine power system is mainly applied in geothermal power plants, solar energy, industrial waste heat and biomass thermal power generation. The companies mastering organic Rankine cycle power generation technology mainly include Electra Therm, Turboden, Eneftech, Ormat, Freepower, Green Energy Australasia and Infinity turbine etc all over the world. The development of organic Rankine cycle power generation technology and system in China began in the early 1970s. Although organic Rankine cycle power generation technology has been developed over years, China is technically not been able to achieve substantial breakthroughs.

The conventional organic working fluid generation method has to work with external power. The working fluid need to be pressured by the pump to maintain normal power state, while the working fluid pump itself needs to consume a lot of power, resulting in reduced overall system efficiency. In addition, the control process also requires externally supplied power. So the conventional organic Rankine cycle power generation system largely depends on external power and needs equipment maintenance costs.

SUMMARY OF THE INVENTION

The purpose of the present invention is to overcome deficiencies existed in above prior art, and provides a passive low temperature heat energy organic working fluid power generation method and system with reliable performance, and is operated by heating and evaporating of the working fluid in a closed space to achieve increased pressure and liquid level change.

The present invention has no external power supply, and the power generation process is controlled by a self-operated pressure regulator valve and a self-operated liquid regulator valve.

The purpose of the present invention can be realized by following technical schemes:

In one aspect, the present invention provides a passive low temperature heat energy organic working fluid power generation system, comprising a turbine, a generator, a coupling connecting the turbine and the generator, a condenser, a liquid-storage tank, a first evaporator, a second evaporator, a first self-operated pressure regulator valve, a first self-operated liquid regulator valve, a second self-operated pressure regulator valve, a second self-operated liquid regulator valve, a third self-operated liquid regulator valve, a fourth self-operated liquid regulator valve, a first non-return valve, a second non-return valve, a third non-return valve, a heat source pipeline, a cold source pipeline and a connecting pipeline; a bottom outlet of the liquid-storage tank is divided into two branches, wherein one branch is connected with an organic working fluid channel inlet of the first evaporator through the third self-operated liquid regulator valve; and an organic working fluid channel outlet of the first evaporator is connected with an inlet of the turbine through the first self-operated pressure regulator valve, the second non-return valve and the connecting pipeline sequentially; the other branch of the bottom outlet of the liquid-storage tank is connected with an organic working fluid channel inlet of the second evaporator through the fourth self-operated liquid regulator valve; an organic working fluid channel outlet of the second evaporator is connected with an inlet of the turbine through the second self-operated pressure regulator valve, the third non-return valve and the connecting pipeline sequentially; an outlet of the turbine is connected with an organic working fluid channel inlet of the condenser through the connecting pipeline; an organic working fluid channel outlet of the condenser is connected with an inlet of the liquid-storage tank through the first non-return valve; a top of the liquid-storage tank is divided into two branches, in one branch, the top of the liquid-storage tank is connected with the organic working fluid channel outlet of the first evaporator through the first self-operated pressure regulator valve; and in the other branch, the top of the liquid-storage tank is connected with the organic working fluid channel outlet of the second evaporator through the second self-operated liquid regulator valve.

In another aspect, the present invention provides a passive low temperature heat energy organic working fluid power generation method, comprising following steps:

Alternatively, the organic working fluid comprises R245fa, R600, R600a, R141b and R142b.

Alternatively, the organic working fluid in the first evaporator is heated and evaporated, the temperature reaches 60.degree. C. to 180.degree. C., and the pressure reaches the setting pressure 0.5 MPa-5 MPa, the first self-operated pressure regulator valve of the outlet of the first evaporator reaches the setting pressure and waits to be triggered opening.

When the liquid level of the first evaporator decreases to the setting value 0-200 mm, the first self-operated liquid regulator valve and the third self-operated liquid regulator valve are triggered opening; when the first evaporator is filled with the working fluid and the liquid level inside rises to the setting value 400-500 mm, the first self-operated liquid regulator valve and the third self-operated liquid regulator valve are triggered closing.

Alternatively, the organic working fluid in the second evaporator is heated and evaporated, the temperature reaches 60.degree. C. to 180.degree. C., and the pressure reaches the setting pressure 0.5 MPa-5 MPa, the second self-operated pressure regulator valve of the outlet of the second evaporator reaches the setting pressure and waits to be triggered opening.

When the liquid level of the second evaporator decreases to the setting value 0-200 mm, the second self-operated liquid regulator valve and the fourth self-operated liquid regulator valve are triggered opening; when the second evaporator is filled with the working fluid and the liquid level inside rises to the setting value 400-500 mm, the second self-operated liquid regulator valve and the fourth self-operated liquid regulator valve are triggered closing.

Alternatively, the temperature of the gas organic working fluid of an inlet of the turbine ranges from 60.degree. C. to 180.degree. C., and the pressure ranges from 0.5 MPa to 5 MPa.

Alternatively, the pressure of the gas organic working fluid of the outlet of the turbine ranges from 0.5 MPa to 5 MPa, and the outlet temperature ranges from 30.degree. C. to 120.degree. C.

Alternatively, a position of the liquid-storage tank is 200-2000 mm higher than that of the first evaporator and the second evaporator, and the liquid working fluid is transmitted by gravitational potential energy difference.

Alternatively, the heat source for heating the first evaporator and the second evaporator is geothermal energy, solar energy or industrial waste heat, and the heat source temperature ranges from 85.degree. C. to 200.degree. C.

Alternatively, the turbine expansion ratio ranges from 1.5 to 15. Compared with prior art, the present invention utilizes gravity to transmit liquid working fluid, the system has no working fluid pump and no external power supply, besides the system is operated by heating and evaporating of the working fluid in a closed space to achieve increased pressure; the power generation process is controlled by self-operated pressure regulator valves and self-operated liquid regulator valves to realize power generation, the whole power generation system has simple structure, reliable performance and lower cost, besides, it is easy to realize miniaturization and practicability.

BRIEF DESCRIPTION OF THE DRAWINGS

In FIGS. 1 and 2, 1: turbine. 2: generator, 3: condenser, 4: liquid-storage tank, 5: first evaporator, 6: second evaporator, 7: first self-operated pressure regulator valve, 8: first self-operated liquid regulator valve 9: second self-operated pressure regulator valve, 10: second self-operated liquid regulator valve, 11: third self-operated liquid regulator valve, 12: fourth self-operated liquid regulator valve, 13-1, 13-2 and 13-3: non-return valve, 14: coupling, 15—heat source, 16: cold source, 17: heat source pipeline, 18: connecting pipeline, 19: cold source pipeline, 20: floating ball, 21: outlet of working fluid, 22: filter screen, 23: inlet of working fluid, 24: combined sealing ring, 25: top cover of controller, 26: vent valve, 27: adjusting device, 28: spring, 29: control pipeline, 30: inner cavity support, 31: main valve element, 32: device cover.

DETAILED DESCRIPTION OF THE INVENTION

The present invention is described in detail with reference to embodiments and drawings.

Figure 1:
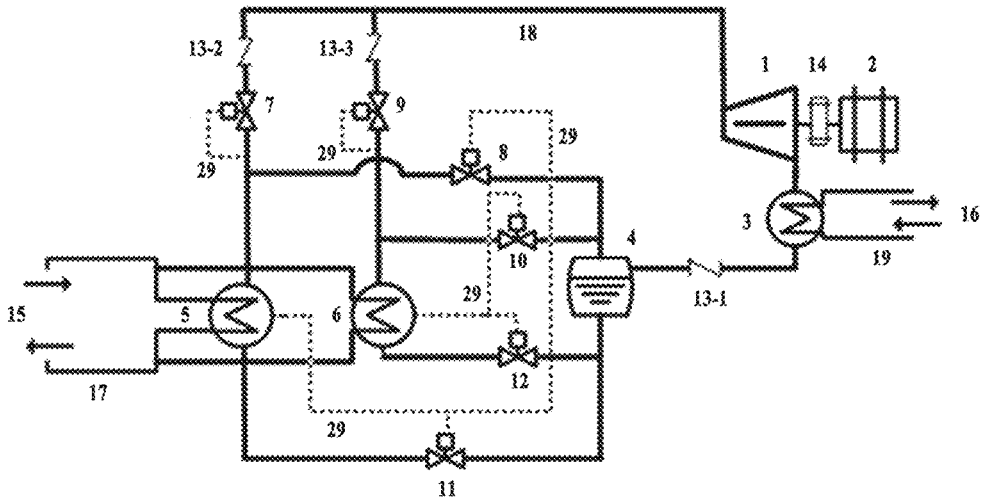
FIG. 1 is a structure diagram of a device used in this method.

See FIG. 1, FIG. 1 is a structure of passive organic working fluid power generation device, as shown in FIG. 1, the device comprises:

a turbine 1, a generator 2, a coupling 14 connecting the turbine 1 and the generator 2, a condenser 3, a liquid-storage tank 4, a first evaporator 5, a second evaporator 6, a first self-operated pressure regulator valve 7, a first self-operated liquid regulator valve 8, a second self-operated pressure regulator valve 9, a second self-operated liquid regulator valve 10, a third self-operated liquid regulator valve 11, a fourth self-operated liquid regulator valve 12, a non-return valve 13-1, a non-return valve 13-2 and a non-return valve 13-3, a heat source pipeline 17, a cold source pipeline 19 and a connecting pipeline 18. A bottom outlet of the liquid-storage tank 4 is divided into two branches, wherein one branch is connected with an organic working fluid channel inlet of the first evaporator 5 through the third self-operated liquid regulator valve 11. And an organic working fluid channel outlet of the first evaporator 5 is connected with an inlet of the turbine 1 through the first self-operated pressure regulator valve 7, the non-return valve 13-2 and the connecting pipeline 18 sequentially. The other branch of the bottom outlet of the liquid-storage tank 4 is connected with an organic working fluid channel inlet of the second evaporator 6 through the fourth self-operated liquid regulator valve 12. The organic working fluid channel inlet of the second evaporator 6 is connected with an inlet of the turbine 1 through the second self-operated pressure regulator valve 9, the non-return valve 13-3 and the connecting pipeline 18 sequentially. An outlet of the turbine 1 is connected with an organic working fluid channel inlet of the condenser 3 through the connecting pipeline 18. An organic working fluid channel outlet of the condenser 3 is connected with an inlet of the liquid-storage tank 4 through the non-return valve 13-1. A top of the liquid-storage tank 4 is divided into two branches, in one branch, the top of the liquid-storage tank 4 is connected with the organic working fluid channel outlet of the first evaporator 5 through the first self-operated pressure regulator valve 8. And in the other branch, the top of the liquid-storage tank 4 is connected with the organic working fluid channel outlet of the second evaporator 6 through the second self-operated liquid regulator valve 10. Fluid of external low temperature heat source 15 flows into the heat source pipeline 17 and heats the first evaporator 1 and the second evaporator 2 through the heat source pipeline 17 respectively. Fluid of the external cold source 16 flows into the cold source pipeline 19 and cools the condenser 3 through the cold source pipeline 19.

Figure 2:
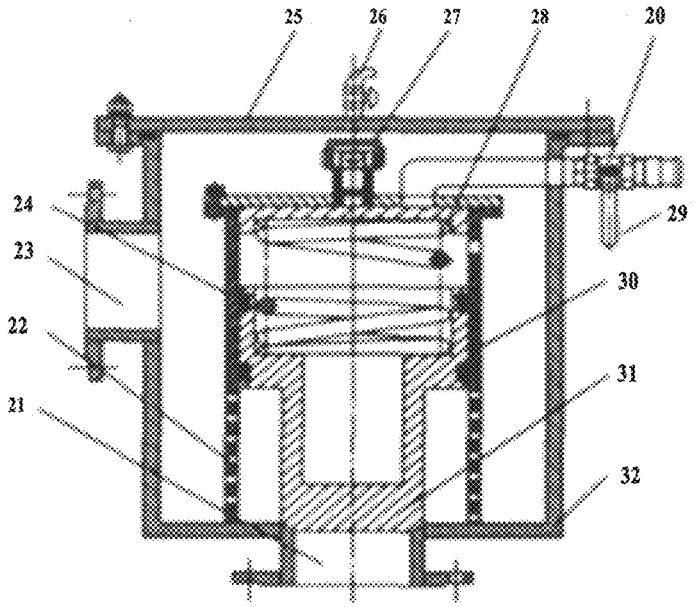
FIG. 2 is a structure diagram of self-operated liquid regulator valve in the embodiments of the disclosure.

The self-operated liquid regulator valve comprises a floating ball 20, a control pipeline 29, a spring 28, an adjusting device 27, an inner cavity support and a main valve element 31. The liquid level value is controlled through setting height of the floating ball 20, when the liquid level of the working fluid in the evaporator is higher than (or smaller than) the setting value, the valve door is triggered closing (or opening). The working principle is as follows: the liquid level of the working fluid in the evaporator is controlled by the floating ball 20, as shown in FIG. 2, the working fluid in the evaporator flows inside the inner cavity support 30 through the control pipeline 29 of the self-operated liquid regulator valve, and the opening and closing of the first self-operated liquid regulator valve 8 and the second self-operated liquid regulator valve 10 mainly depend on the stress state of the main valve element 31 and deformation condition of the spring 28. When the main valve element 31 is not triggered opening, the working fluid flows from the inlet of working fluid 23 to the lower part of the main valve element 31 through the filter screen 22, the upward force formed by pressure of the working fluid is greater than the setting force of the spring 28, and the main valve element 31 is triggered opening and starting normal working fluid filling. When the liquid level of the working fluid in the evaporator rises to the setting value, the control pipeline 29 is conducted by the floating ball 20, so that the fluid pressure consistent with the outer cavity is established inside the inner cavity support 30 of the self-operated liquid regulator valve. The main valve element 31 is triggered closing under action of the spring 28, and total liquid level control process is completed.

The working principle of the self-operated pressure regulator valve is similar to that of the self-operated liquid regulator valve, and the difference is the self-operated pressure regulator valve is without the floating ball 20, the opening and closing of the valve door is controlled directly by working fluid pressure of valve door inlet and atmospheric pressure difference, the working principle is as follows: the spring, pressure sensing film and valve rod inside the self-operated pressure regulator valve are bonded together, the control pressure P is guided to the seal cavity of upper part of the pressure sensing film by the pressure guiding pipe, the lower part of the pressure sensing film is connected with the atmosphere, and atmospheric pressure is P0. Opening pressure setting value Ps1 and closing pressure setting value Ps2 are set firstly, the pre-compression amount of the spring is determined by the setting value .DELTA.Ps of P1*s*-P0, that is, the elastic force of the spring is equal to acting force of the pressure sensing film on the spring under condition of setting differential pressure. The working can be divided into two situations to explain: (1) the current state is closed, if P1-P0 is smaller than setting differential pressure .DELTA.Ps, closing is maintained, and the self-operated pressure regulator valve at this time is a shutoff valve. If P1-P0 is greater than setting differential pressure .DELTA.Ps, the pressure sensing film overcomes the elastic force of the spring and drives the valve door, and the valve door is triggered opening. (2) the current state is open, if the system is operated stably, the differential pressure .DELTA.P of the inlet and outlet is approximate to the setting differential pressure. If .DELTA.P is increased with change of working condition of the system, the valve door is triggered opening widely, and flow is increased; when balanced state is achieved, .DELTA.P falls back approximate to .DELTA.Ps, when the valve door is maximum opening, .DELTA.P is greater than .DELTA.Ps, and the valve door has no ability to adjust and regulate differential pressure. If .DELTA.P is smaller than .DELTA.Ps with change of working condition of the system, the valve door is triggered opening narrowly, and flow is decreased; when balanced state is achieved, .DELTA.P falls up approximate to .DELTA.Ps, until the valve door is closed, .DELTA.P is smaller than .DELTA.Ps, and the valve door has no ability to adjust and regulate differential pressure, and the self-operated pressure regulator valve becomes a shutoff valve. In short, when the self-operated pressure regulator valve is in closed state, it is triggered opening only if .DELTA.P is greater than .DELTA.Ps; and when the self-operated pressure regulator valve is in opening state, opening can be adjusted automatically to keep basically constant of differential pressure front and back of the valve door.

The external low temperature heat source 15 can be geothermal energy, solar energy or industrial waste heat. The low temperature heat source 15 is directly or indirectly in contact with outer wall of the first evaporator 5 and the second evaporator 6 to evaporate the liquid organic working fluid inside the first evaporator 5 and the second evaporator 6.

The cold source 16 of the condenser 3 can be liquid or gaseous fluid, and the cold source flows through the cold source pipeline and takes away heat of the condenser, thereby condensing the gaseous working fluid. The gaseous fluid may be blew into the cold source pipeline through a blower. In one preferred embodiment, the liquid flowing through the cold source pipeline can be water, and the heat of the condenser is taken away through heat exchange.

The organic working fluid in the present invention comprises R245fa, R600, R600a, R141b, R142b. Compared with the setting height of the first evaporator 5 and the second evaporator 6, the liquid-storage tank 4 is 200-2000 m higher, so that gravity potential energy difference is utilized to transmit condensed liquid working fluid.

The present invention also provides a passive low temperature heat energy organic working fluid power generation method, comprising following steps:

the low temperature heat source 15 conducts the heat energy to the first evaporator 5 through the heat source pipeline 17. The liquid organic working fluid with low melting point in the first evaporator 5 is heated and evaporated, so that the temperature and pressure inside the first evaporator 5 are continually increased. When a pressure in the first evaporator 5 reaches the setting value, the first self-operated pressure regulator valve 7 of an outlet of the first evaporator 5 is triggered opening under the working pressure; the gaseous organic working fluid flows into the turbine 1 through the non-return valve 13-2 and the connecting pipeline 18 sequentially, and drives the turbine 1 to work. The turbine 1 drives the generator 2 to rotate by the coupling 14 and outputs electric energy. After work is completed, the gaseous organic working fluid flows into the condenser 3 to be condensed, so that the gaseous organic working fluid becomes the liquid organic working fluid. Meanwhile, with volume of the gaseous organic working fluid decreasing suddenly, a stable differential pressure is formed between the turbine 1 and the condenser 3, and the stable differential pressure maintains the turbine 1 to work continuously. And the setting of non-return valve (13-1, 13-2 and 13-3) ensures gaseous organic working fluid or liquid organic working fluid can only be conducted to one direction.

The condensed liquid organic working fluid flows into the liquid-storage tank 4 through the non-return valve 13-1; with the consumption of organic working fluid in the first evaporator 5, the pressure in the first evaporator 5 decreases greatly, and when the pressure inside the first evaporator decreases to the setting value of the first self-operated pressure regulator valve 7, the first self-operated pressure regulator valve 7 is triggered closing. Meanwhile, when the liquid level in the first evaporator 5 decreases to the setting value of the first self-operated liquid regulator valve 8 and the third self-operated liquid regulator valve 11, the first self-operated liquid regulator valve 8 and the third self-operated liquid regulator valve 11 are triggered opening simultaneously, and the top of the liquid-storage tank 4 and the organic working fluid channel outlet of the first evaporator 5 are connected through the first self-operated liquid regulator valve 8, so that the pressure of the top of the liquid-storage tank 4 is the same with that of the organic working fluid channel outlet of the first evaporator 5, and the gaseous phase and liquid phase of organic working fluid are balanced. Compared with the setting height of the first evaporator 5 and the second evaporator 6, the liquid-storage tank 4 is 200-2000 m higher, the liquid organic working fluid in the liquid-storage tank 4 flows into the first evaporator 5 through the third self-operated liquid regulator valve 11 under gravity. After a filling of the liquid working fluid in the first evaporator 5 is completed, the liquid level of the first evaporator 5 rises to the setting value, and the first self-operated liquid regulator valve 8 and the third self-operated liquid regulator valve 1 are triggered closing simultaneously, the organic working fluid in the first evaporator 5 is heated for a next cycle.

When the first evaporator 5 is filled with the liquid organic working fluid, the working fluid in the second evaporator 6 is heated and evaporated, so that the pressure of the second evaporator 6 reaches the setting value of the second self-operated pressure regulator valve 9. The second self-operated pressure regulator valve 9 is triggered opening, and the first evaporator 5 is replaced to output gaseous working fluid continually, and drive the turbine 1 and the generator 2 to work and output electric energy through the non-return valve 13-3 and connecting pipeline 18. The condensed liquid organic working fluid flows into the liquid-storage tank 4 through the non-return valve 13-1; with constant consumption of organic working fluid in the second evaporator 6, the pressure in the second evaporator decreases greatly. When the pressure in the second evaporator 6 decreases to the setting value of the second self-operated pressure regulator valve 9, the second self-operated pressure regulator valve 9 is triggered closing. The method for filling working fluid in the second evaporator 6 has same principle with the method for filling liquid working fluid in the first evaporator 5, that is, after the second self-operated pressure regulator valve 9 is triggered closing, the liquid level in the second evaporator 6 decreases to the setting value of the second self-operated liquid regulator valve 10 and the fourth self-operated liquid regulator valve 12, the second self-operated liquid regulator valve 10 and the fourth self-operated liquid regulator valve 12 are triggered opening simultaneously; the top of the liquid-storage tank 4 and the organic working fluid channel outlet of the second evaporator 6 are connected through the opening of the second self-operated liquid regulator valve 10, and the gaseous phase and liquid phase of organic working fluid are balanced. The liquid organic working fluid flows from the liquid-storage tank 4 into the second evaporator 6 under gravity. The second self-operated liquid regulator valve 10 and the fourth self-operated liquid regulator valve 12 are triggered opening after the second self-operated pressure regulator valve 9 is triggered closing. After the filling of the liquid organic working fluid in the second evaporator 6 is completed, the liquid level of the second evaporator 6 rises to the setting value, and the second self-operated liquid regulator valve 10 and the fourth self-operated liquid regulator valve 12 are triggered closing, the organic working fluid in the second evaporator 6 is heated for the next cycle;

During a filling of the second evaporator 6 and being heated to a working point, the pressure of the working fluid of the first evaporator 5 is heated to the setting value according to a pre-set design and the second evaporator 6 is being replaced to output working steam, the first evaporator 5 and second evaporator 6 output gaseous working fluid, and drive the turbine 1 to work continuously and output electric energy.

The organic working fluid in the disclosure comprises R245fa, R600, R600a, R141b, and R142b. It should be understood that other low boiling point organic materials shall be included in the scope of the disclosure if the embodiments can be realized.

In this embodiment, the low temperature heat energy between 60. degree. C. to 200.degree. C. such as solar energy, geothermal heat and low temperature waste heat can be used as heat sources. The working pressure of the evaporator is the saturated pressure corresponding to the liquid working fluid when the heat source temperature ranges from 60.degree. C. to 200.degree. C. The underground water, river water, seawater or air are used as cold source, cold source temperature ranges from 0.degree. C. to 40.degree. C., and the working pressure of the condenser is the saturated pressure corresponding to the liquid working fluid when the cooling water or cooling air ranges from 0.degree. C. to 40.degree. C. The device can use underground water, river water, seawater or air as cold source to work, and can realize the generated power ranging from several kilowatts to hundreds of kilowatts.

In one preferred embodiment, the organic working fluid in the first evaporator 5 is heated and evaporated, the temperature reaches 60. degree. C.-180.degree. C., and the pressure reaches the setting pressure 0.5 MPa-5 MPa.

When the liquid level of the first evaporator 5 decreases to the setting value 0-200 mm, the first self-operated liquid regulator valve 8 and the third self-operated liquid regulator valve 11 are triggered opening; when the first evaporator 5 is filled with the working fluid and the liquid level inside rises to the setting value 400-500 mm, the first self-operated liquid regulator valve 8 and the third self-operated liquid regulator valve 11 are triggered closing. The organic working fluid in the second evaporator 6 is heated and evaporated, the temperature reaches 60.degree. C.-180.degree. C., and the pressure reaches the setting pressure 0.5 MPa-5 MPa. When the liquid level of the second evaporator 6 decreases to the setting value 0-200 mm, the second self-operated liquid regulator valve 10 and the fourth self-operated liquid regulator valve 12 are triggered opening; when the second evaporator 6 is filled with the working fluid and the liquid level inside rises to the setting value 400-500 mm, the second self-operated liquid regulator valve 10 and the fourth self-operated liquid regulator valve 12 are triggered closing.

The non-return valve 13-1 prevents the first evaporator and second evaporator from suddenly raising the abnormal pressure during the liquid supply and causes the liquid working substance to flow back into the condenser 3, thereby affecting the normal operation of the condenser 3. When the system malfunctions or is not operating as intended, for example, when the liquid working fluid is not sufficient in the first evaporator 5 but the first self-operated pressure control valve 7 is not closed, the second self-operated pressure regulator valve 9 of the outlet of the second evaporator 6 reaches the triggering pressure and is triggered opening, the non-return valve 13-2 prevents the high-pressure working fluid steam from the second evaporator 6 from flowing back into the first evaporator 5, similarly, when the second self-operated pressure control valve 9 is not closed, and the first self-operated pressure control valve 7 is triggered opening, the non-return valve 13-3 prevents the high-pressure working fluid steam from the first evaporator 5 from flowing back into the second evaporator 6.

Embodiment 1

Working fluid R600a, heat source 15 temperature 120.degree. C., cold source 16 temperature 20.degree. C. Evaporation temperature of evaporator is 100.degree. C., evaporation pressure is 1.98 Mpa, steam production rate is 1.8 kg/s, condensed temperature of condenser is 30.degree. C., condensed pressure is 0.403 Mpa, heat exchanger efficiency is 0.9; turbine expansion ratio is 5.0 and turbine efficiency is 0.8. Besides, the internal volume of the first evaporator and the second evaporator is 0.2 m.sup.3, the internal volume of the liquid-storage tank 4 is 0.4 m.sup.3, and the internal initial liquid storage is 120 kg. The present invention is performed by following steps:

(1) the first self-operated liquid regulator valve 8 and the third self-operated liquid regulator valve 11 are opened automatically, the liquid organic working fluid about 30.degree. C. in the liquid-storage tank 4 flows into the first evaporator 5 under gravity, the liquid level in the first evaporator 5 rises to the setting value, and the first self-operated liquid regulator valve 8 and the third self-operated liquid regulator valve 11 are triggered closing, and 60 kg of liquid working fluid is closed in the first evaporator;

(2) the liquid working fluid in the first evaporator 5 is heated and evaporated, working fluid temperature and pressure increase continuously to 100.degree. C. and 1.98 Mpa, which is steam parameter of the inlet of the turbine 1;

(3) the first self-operated pressure regulator valve 7 at the outlet of the first evaporator 5 is opened under pressure, working steam flows into the turbine 1 for expansion and working with a mass velocity of 1.8 kg/s, and drives the generator 2 to output electric energy, the pressure and temperature of the outlet of turbine 1 are respectively 0.403 Mpa and 47.4.degree. C.;

(4) the working fluid is condensed to 30.degree. C. of statured liquid in the condenser 3, and flows into the liquid-storage tank 4;

(5) in the power generation process, the liquid working fluid in the first evaporator 5 is heated constantly and evaporated, after about 26 s, the pressure in the first evaporator 5 decreases greatly, and the first self-operated pressure regulator valve 7 is triggered closing, meanwhile, the liquid level in the first evaporator 5 decreases gradually close to the setting value of the first self-operated pressure regulator valve 8 and the third self-operated liquid regulator valve 11, remained liquid working fluid are heated and evaporated continually, when the liquid level reaches the setting value of the first self-operated pressure regulator valve 8 and the third self-operated liquid regulator valve 11, the first self-operated pressure regulator valve 8 and the third self-operated liquid regulator valve 11 are triggered opening, the liquid working fluid in the liquid-storage tank 4 flows into the first evaporator 5 under gravity. After a period of filling the liquid level in the first evaporator 5 to the setting value, the first self-operated pressure regulator valve 8 and the third self-operated liquid regulator valve 11 are triggered closing, the working fluid in the first evaporator 5 is heated and pressure increased, when the design working point is reached, the first evaporator 5 replaces the second evaporator 6 to output working steam continually;

(6) during the filling process with the working fluid of the first evaporator 5, according to the pre-set design, the working fluid in the second evaporator 6 has reached the working point, the second self-operated pressure regulator valve 9 is triggered opening by working pressure in the second evaporator 6, and the first evaporator 5 is being replaced to output working steam and drive the turbine 1 and generator 2 to output electric energy. After 26 s, the pressure in the second evaporator 6 decreases greatly, and the second self-operated pressure regulator valve 9 is triggered closing, the method of filling working fluid in the second evaporator 6 is the same with that of the first evaporator 5, the liquid level in the second evaporator 6 decreases close to the setting value of the second self-operated liquid regulator valve 8 and the fourth self-operated liquid regulator valve 12, and second self-operated liquid regulator valve 8 and the fourth self-operated liquid regulator valve 12 are triggered opening, the liquid working fluid in the liquid-storage tank 4 flows into the first evaporator 5 under gravity; meanwhile, according to the pre-set design, the working fluid in the first evaporator 5 has reached working point, and the first-operated pressure regulator valve 7 is triggered opening, and the first evaporator 5 replaces the second evaporator 6 to output working steam continually, and drive the turbine 1 and generator 2 to output electric energy;

(7) the present invention uses two evaporators—the first evaporator 5 and the second evaporator 6 to output high temperature high pressure steam in turn to drive the turbine 1 and the generator 2, thereby ensuring the device can output electric energy continuously.

In this embodiment, the thermal efficiency of system is 13.7%, and generated power is 56.8 KW.

Embodiment 2

Working fluid R245fa, heat source 15 temperature 120.degree. C., cold source 16 temperature 20.degree. C. Evaporation temperature of evaporator is 100.degree. C., evaporation pressure is 1.26 Mpa, steam production rate is 4 kg/s, condensed temperature of condenser is 30 DEG, condensed pressure is 0.177 Mpa, heat exchanger efficiency is 0.9; turbine 1 expansion ratio is 7.1 and turbine efficiency is 0.8. Besides, the internal volume of the first evaporator and the second evaporator is 2 m.sup.3, the internal volume of the liquid-storage tank 4 is 3 m.sup.3, and the internal initial liquid storage is 2400 kg. The present invention is performed by following steps:

(1) the first self-operated liquid regulator valve 8 and the third self-operated liquid regulator valve 11 are triggered opening, the liquid organic working fluid about 30.degree.

C. in the liquid-storage tank 4 flows into the first evaporator 5 under gravity, after a period of filling, the liquid level of the first evaporator 5 rises to the setting value, the first self-operated liquid regulator valve 8 and the third self-operated liquid regulator valve 11 are triggered closing, and 1200 kg of liquid working fluid is closed in the first evaporator;

(2) the liquid working fluid in the first evaporator 5 is heated and evaporated, working fluid temperature and pressure increase continuously to reach 100.degree. C. and 1.26 Mpa finally, which is steam parameter of the inlet of the turbine 1;

(3) the first self-operated pressure regulator valve 7 at the outlet of the first evaporator 5 is opened automatically under pressure, working steam flows into the turbine 1 for expansion and working with a mass velocity of 4 kg/s, and drives the generator 2 to output electric energy, the pressure and temperature of turbine 1 outlet are respectively 0.177 Mpa and 49.5.degree. C.;

(4) the working fluid is condensed to 30.degree. C. of statured liquid in the condenser 3, and flows into the liquid-storage tank 4.

In the power generation process, the liquid working fluid in the first evaporator 5 is heated constantly and evaporated, after 260 s, the pressure in the first evaporator 5 decreases greatly, and the first self-operated pressure regulator valve 7 is triggered closing, meanwhile, the liquid level in the first evaporator 5 decreases gradually close to the setting value of the first self-operated pressure regulator valve 8 and the third self-operated liquid regulator valve 11, remained liquid working fluid are heated and evaporated continually, when the liquid level reaches the setting value of the first self-operated pressure regulator valve 8 and the third self-operated liquid regulator valve 11, the first self-operated pressure regulator valve 8 and the third self-operated liquid regulator valve 11 are triggered opening, the liquid working fluid in the liquid-storage tank 4 flows into the first evaporator 5 under gravity. After a period of filling working fluid, the liquid level of the first evaporator 5 rises to the setting value, and the first self-operated pressure regulator valve 8 and the third self-operated liquid regulator valve 11 are triggered closing, the working fluid in the first evaporator 5 is heated and pressure increased, when the design working point is reached, the first evaporator 5 replaces the second evaporator 6 to output working steam continually;

(6) during the filling process with the working fluid of the first evaporator 5, according to the pre-set design, the working fluid in the second evaporator 6 has reached the working point, the second self-operated pressure regulator valve 9 is triggered opening by working pressure in the second evaporator 6, and the first evaporator 5 is replaced to output working steam and drive the turbine 1 and generator 2 to output electric energy. After 260 s, the pressure in the second evaporator 6 decreases greatly, and the second self-operated pressure regulator valve 9 is triggered closing, the method of refilling working fluid of the second evaporator 6 is the same with that of the first evaporator 5, the liquid level in the second evaporator 6 decreases gradually close to the setting value of the second self-operated liquid regulator valve 8 and the fourth self-operated liquid regulator valve 12, and second self-operated liquid regulator valve 8 and the fourth self-operated liquid regulator valve 12 are triggered opening, the liquid working fluid in the liquid-storage tank 4 flows into the first evaporator 5 under gravity; meanwhile, according to the pre-set design, the working fluid in the first evaporator 5 has reached working point, and the first-operated pressure regulator valve 7 is triggered opening, and the first evaporator 5 replaces the second evaporator 6 to output working steam continually, and drive the turbine 1 and generator 2 to output electric energy.

(7) the present invention uses two evaporators—the first evaporator 5 and the second evaporator 6 to output high temperature high pressure steam in turn to drive the turbine 1 and the generator 2, thereby ensuring the device can output electric energy continuously.

In this embodiment, the thermal efficiency of system is 15.5%, and generated power is 92.6 KW.

Embodiment 3

Working fluid R141b, heat source 15 temperature 120.degree. C., cold source 16 temperature 20.degree. C. Evaporation temperature of evaporator is 100.degree. C. evaporation pressure is 0.675 Mpa, steam production rate is 20 kg/s, condensed temperature of condenser is 30 DEG, condensed pressure is 0.094 Mpa, heat exchanger efficiency is 0.9; turbine expansion ratio is 7.2 and turbine efficiency is 0.8. Besides, the internal volume of the first evaporator and the second evaporator is 2 m.sup.3, the internal volume of the liquid-storage tank 4 is 3 m.sup.3, and the internal initial liquid storage is 2400 kg. The present invention is performed by following steps:

(1) the first self-operated liquid regulator valve 8 and the third self-operated liquid regulator valve 11 are opened automatically, the liquid organic working fluid about 30.degree. C. in the liquid-storage tank 4 flows into the first evaporator 5 under gravity, the liquid level in the first evaporator 5 rises to the setting value, and the first self-operated liquid regulator valve 8 and the third self-operated liquid regulator valve 11 are triggered closing, and 1200 kg of liquid working fluid is closed in the first evaporator;

(2) the liquid working fluid in the first evaporator 5 is heated and evaporated, working fluid temperature and pressure increase continuously to 100.degree. C. and 0.675 Mpa, which is steam parameter of the inlet of the turbine 1;

(3) the first self-operated pressure regulator valve 7 at the outlet of the first evaporator 5 is opened under pressure, working steam flows into the turbine 1 for expansion and working with a mass velocity of 4 kg/s, and drives the generator 2 to output electric energy, the pressure and temperature of the outlet of turbine 1 are respectively 0.094 Mpa and 44.5.degree. C.;

(4) the working fluid is condensed to 30.degree. C. of statured liquid in the condenser 3, and flows into the liquid-storage tank 4;

(5) in the power generation process, the liquid working fluid in the first evaporator 5 is heated constantly and evaporated, after about 55.9 s, the pressure in the first evaporator 5 decreases greatly, and the first self-operated pressure regulator valve 7 is triggered closing, meanwhile, the liquid level in the first evaporator 5 decreases gradually close to the setting value of the first self-operated pressure regulator valve 8 and the third self-operated liquid regulator valve 11, remained liquid working fluid are heated and evaporated continually, when the liquid level reaches the setting value of the first self-operated pressure regulator valve 8 and the third self-operated liquid regulator valve 11, the first self-operated pressure regulator valve 8 and the third self-operated liquid regulator valve 11 are triggered opening, the liquid working fluid in the liquid-storage tank 4 flows into the first evaporator 5 under gravity. After a period of filling the liquid level in the first evaporator 5 to the setting value, the first self-operated pressure regulator valve 8 and the third self-operated liquid regulator valve 11 are triggered closing, the working fluid in the first evaporator 5 is heated and pressure increased, when the design working point is reached, the first evaporator 5 replaces the second evaporator 6 to output working steam continually;

(6) during the filling process with the working fluid of the first evaporator 5, according to the pre-set design, the working fluid in the second evaporator 6 has reached the working point, the second self-operated pressure regulator valve 9 is triggered opening by working pressure in the second evaporator 6, and the first evaporator 5 is replaced to output working steam and drive the turbine 1 and generator 2 to output electric energy. After 55.9 s, the pressure in the second evaporator 6 decreases greatly, and the second self-operated pressure regulator valve 9 is triggered closing, the method of filling working fluid in the second evaporator 6 is the same with that of the first evaporator 5, the liquid level in the second evaporator 6 decreases close to the setting value of the second self-operated liquid regulator valve 8 and the fourth self-operated liquid regulator valve 12, and second self-operated liquid regulator valve 8 and the fourth self-operated liquid regulator valve 12 are triggered opening, the liquid working fluid in the liquid-storage tank 4 flows into the first evaporator 5 under gravity; meanwhile, according to the pre-set design, the working fluid in the first evaporator 5 has reached working point, and the first-operated pressure regulator valve 7 is triggered opening, and the first evaporator 5 replaces the second evaporator 6 to output working steam continually, and drive the turbine 1 and generator 2 to output electric energy;

(7) the present invention uses two evaporators—the first evaporator 5 and the second evaporator 6 to output high temperature high pressure steam in turn to drive the turbine 1 and the generator 2, thereby ensuring the device can output electric energy continuously.

In this embodiment, the thermal efficiency of system is 13.7%, and generated power is 560 KW.

We claim:

1. A passive low temperature heat energy organic working fluid power generation system comprising:

a turbine, a generator, a coupling for connecting the turbine and the generator, a condenser, a liquid-storage tank, a first evaporator, a second evaporator, a first self-operated pressure regulator valve, a first self-operated liquid regulator valve, a second self-operated pressure regulator valve, a second self-operated liquid regulator valve, a third self-operated liquid regulator valve, a fourth self-operated liquid regulator valve, a first non-return valve, a second non-return valve, a third non-return valve, a heat source pipeline, a cold source pipeline, and a connecting pipeline;

wherein a bottom outlet of the liquid-storage tank is divided into two branches, wherein one branch is connected with a first organic working fluid channel inlet of the first evaporator through the third self-operated liquid regulator valve;

and a first organic working fluid channel outlet of the first evaporator is connected with an inlet of the turbine through the first self-operated pressure regulator valve, the second non-return valve and the connecting pipeline sequentially;

the other branch of the bottom outlet of the liquid-storage tank is connected with a second organic working fluid channel inlet of the second evaporator through the fourth self-operated liquid regulator valve; and a second organic working fluid channel outlet of the second evaporator is connected with the inlet of the turbine through the second self-operated pressure regulator valve, the third non-return valve and the connecting pipeline sequentially;

an outlet of the turbine is connected with a third organic working fluid channel inlet of the condenser through the connecting pipeline;

a third organic working fluid channel outlet of the condenser is connected with an inlet of the liquid-storage tank through the first non-return valve;

a top of the liquid-storage tank is divided into two branches, in one branch, the top of the liquid-storage tank is connected with the first organic working fluid channel outlet of the first evaporator through the first self-operated liquid regulator valve;

and in the other branch, the top of the liquid-storage tank is connected with the second organic working fluid channel outlet of the second evaporator through the second self-operated liquid regulator valve.

2. A passive low temperature heat energy organic working fluid power generation method comprising:

a. heating a first evaporator with low temperature heat source to evaporate an organic working fluid in the first evaporator, wherein temperature and pressure inside the first evaporator increase continually;

b. triggering a first self-operated pressure regulator valve to open when a working pressure in the first evaporator reaches a set pressure value of 0.5 to 5 MPa;

wherein the evaporated organic working fluid flows into a turbine through a second non-return valve and a connecting pipeline sequentially to push the turbine;

c. driving a generator by the turbine to rotate through a coupling and output electric energy;

wherein the evaporated organic working fluid flows into a condenser to condense; and a stable differential pressure is formed between the turbine and the condenser with the sudden decrease of volume of the evaporated organic working fluid to keep the turbine working continuously;

d. triggering the first self-operated pressure regulator valve to close when the working pressure inside the first evaporator decreases to a set pressure value lower than 0.5 MPa;

e. triggering a first self-operated liquid regulator valve and a third self-operated liquid regulator valve to open simultaneously when a liquid level of the first evaporator decreases to a set level value of 0 to 200 mm;

wherein the condensed organic working fluid in the liquid-storage tank flows into the first evaporator through the third self-operated liquid regulator valve under gravity;

f. triggering the first self-operated liquid regulator valve and the third self-operated liquid regulator valve to close simultaneously when the liquid level of the first evaporator increases to a set level value of 400 to 500 mm;

g. heating a second evaporator to evaporate the organic working fluid in the second evaporator when the first evaporator is filled with the organic working fluid, and triggering the second self-operated pressure regulator valve to open when a working pressure in the second evaporator reaches a set pressure value of 0.5 to 5 MPa;

wherein the condensed organic working fluid flows into the liquid-storage tank through a first non-return valve;

h. triggering the second self-operated pressure regulator valve to close when the working pressure in the second evaporator decreases to a set pressure value lower than 0.5 MPa;

i. triggering a second self-operated liquid regulator valve and a fourth self-operated liquid regulator valve to open simultaneously when the liquid level in the second evaporator decreases to a set level value of 0 to 200 mm;

wherein the condensed organic working fluid in the liquid-storage tank flows into the second evaporator under gravity;

j. triggering the second self-operated liquid regulator valve and the fourth self-operated liquid regulator valve to close simultaneously when the liquid level of the second evaporator increases to a set level value of 400 to 500 mm, wherein the organic working fluid in the second evaporator is to be heated for a next cycle;

wherein during filling the second evaporator with the organic working fluid and heating the organic working fluid to a working point, the working pressure in the first evaporator reaches the set pressure value of 0.5 to 5 MPa by heating to evaporate the organic working fluid; and the first evaporator and the second evaporator in turn output the evaporated organic working fluid to continuously drive the turbine and output electric energy.

3. The passive low temperature heat energy organic working fluid power generation method of claim 2, wherein the organic working fluid comprises R245fa, R600, R600a, R141b and R142b.

4. The passive low temperature heat energy organic working fluid power generation method of claim 2, wherein the organic working fluid in the first evaporator is heated under 60° C. to 180° C.

5. The passive low temperature heat energy organic working fluid power generation method of claim 2, wherein the organic working fluid in the second evaporator is heated under 60° C. to 180° C.

6. The passive low temperature heat energy organic working fluid power generation method of claim 2, wherein the temperature of the organic working fluid at an inlet of the turbine ranges from 60° C. to 180° C., and the pressure of the organic working fluid at the inlet of the turbine ranges from 0.5 MPa to 5 MPa.

7. The passive low temperature heat energy organic working fluid power generation method of claim 2, wherein the pressure of the organic working fluid at an outlet of the turbine ranges from 0.5 MPa to 5 MPa, and the temperature of the organic working fluid at the outlet of the turbine ranges from 30° C. to 120° C.

8. The passive low temperature heat energy organic working fluid power generation method of claim 2, wherein a position of the liquid-storage tank is 200-2000 mm higher than that of the first evaporator and the second evaporator.

9. The passive low temperature heat energy organic working fluid power generation method of claim 2, wherein the heat source for heating the first evaporator and the second evaporator is geothermal energy, solar energy or industrial waste heat, and a heat source temperature ranges from 85° C. to 200° C.

10. The passive low temperature heat energy organic working fluid power generation method of claim 2, wherein a turbine expansion ratio ranges from 1.5 to 15.

* * * * *